United States Patent [19]

Zysset

[11] 4,394,927

[45] Jul. 26, 1983

[54] METALLIC CONVENIENCE CLOSURE

[75] Inventor: Edgar H. Zysset, Sylvania, Ohio

[73] Assignee: General Can Company, Inc., City of Industry, Calif.

[21] Appl. No.: 301,554

[22] Filed: Sep. 14, 1981

[51] Int. Cl.[3] ..... B65D 17/36; B65D 17/34

[52] U.S. Cl. ..... 220/273

[58] Field of Search ..... 220/269–273

[56] References Cited

U.S. PATENT DOCUMENTS 3,593,877 7/1971 Khoury ..... 220/273

4,108,331 8/1978 Khoury ..... 220/269

*Primary Examiner*—George T. Hall

*Attorney, Agent, or Firm*—Barnes, Kisselle, Raisch, Choate, Whittemore & Hulbert

[57] ABSTRACT

A metallic convenience closure for a cylindrical container comprising a panel with an endless severing line formed in the panel and defining a central removable portion and a peripheral fixed portion. A part of the fixed portion is adapted for attaching a closure to the end of a container to close the end. A manually graspable pull-tab is attached to the removable portion of the panel and has a nose portion movable upon lifting of the tab into position adjacent the score line for severing the score line. The tab includes a first portion riveted to the removable portion of the panel, a second portion extending radially outwardly toward the score line, and a manual graspable portion integral with the second portion and extending radially inwardly. The removable portion of the panel has a portion thereof deformed adjacent the first portion of the tab for preventing rotation of the tab about the axis of the rivet thereby maintaining registry of the nose portion with the score line during the opening of the convenience closure.

5 Claims, 7 Drawing Figures

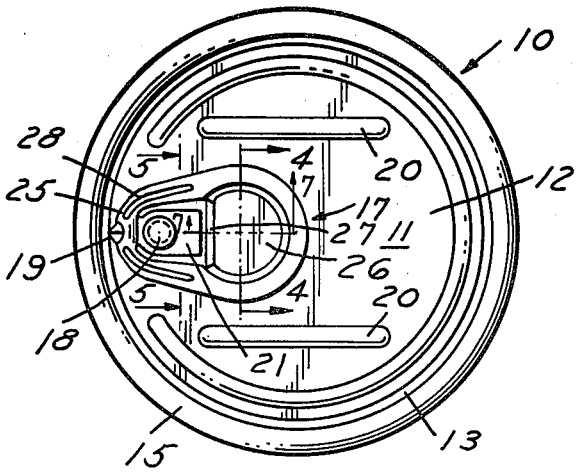
FIG. 1
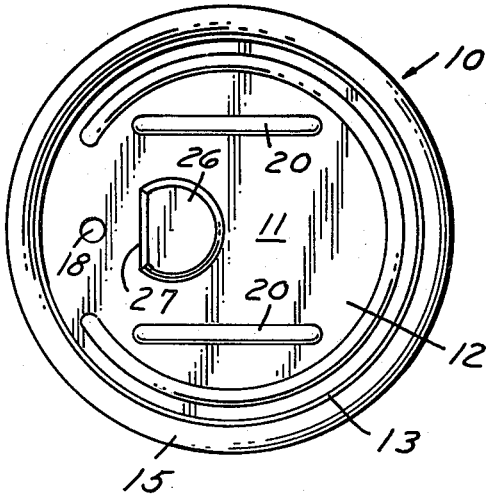
FIG. 2
FIG. 6
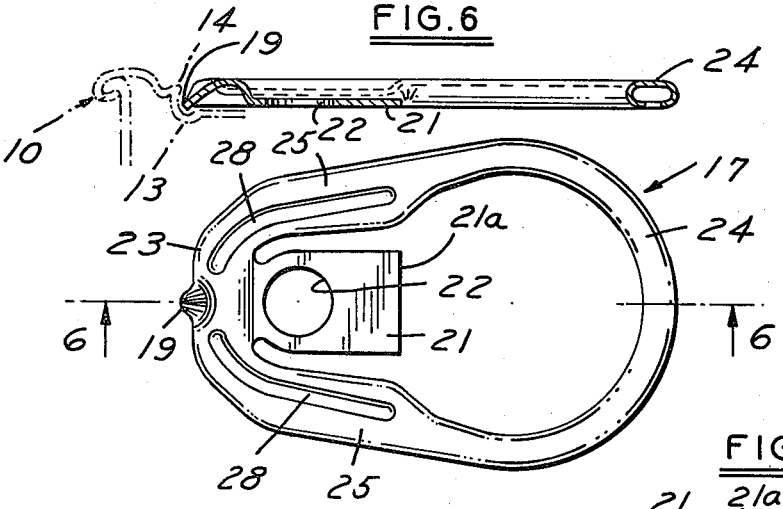
FIG. 3
FIG. 7
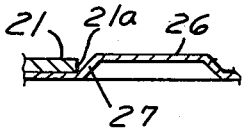
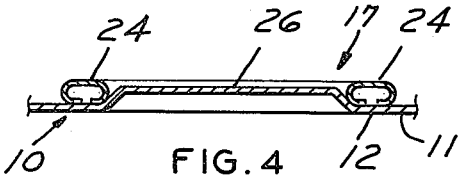
FIG. 4
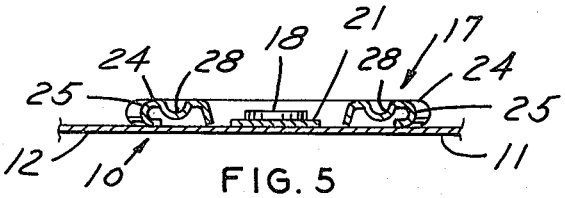
FIG. 5

METALLIC CONVENIENCE CLOSURE

This invention relates to metallic convenience closures for cylindrical containers.

BACKGROUND AND SUMMARY OF THE INVENTION

A common type of metallic convenience closure comprises a panel with an endless score line forming a central removable portion and a peripheral fixed portion that is attached to the cylindrical container. A pull-tab having a nose portion is fastened to the removable portion by a rivet so that when the pull-tab is manually grasped, the nose portion of the pull-tab moves into position adjacent the score line severing the panel. Further movement of the pull-tab completes the severing to remove the removable portion. Typical patents showing such construction are U.S. Pat. Nos. 3,696,961, 3,705,563, 3,819,083 and 3,986,632.

One of the problems with respect to convenience closures is that there is a tendency for the pull-tab to rotate about the rivet axis either during handling of the container or during opening. If the pull-tab rotates more than a predetermined amount, then it is difficult if not impossible to open the convenience closure since the nose portion of the tab will not be close enough to the score line to cause a severing thereof.

Accordingly, among the objectives of the present invention are to provide a metallic convenience closure which will prevent rotation of the pull-tab and thereby insure registration of the nose portion of the pull-tab with the score line.

In accordance with the invention, a portion of the removable portion of the panel of the closure is deformed adjacent a portion of the tab that is riveted to the removable portion to prevent rotation of the tab and maintain registry of the nose portion of the tab with the score line.

DESCRIPTION OF THE DRAWINGS

FIG. 1 is a plan view of a convenience closure embodying the invention.

FIG. 2 is a plan view of the closure with the manually graspable pull-tab removed.

FIG. 3 is a plan view on an enlarged scale of the pull-tab.

FIG. 4 is a fragmentary sectional view on an enlarged scale taken along the line 4—4 in FIG. 1.

FIG. 5 is a fragmentary sectional view on an enlarged scale taken along the line 5—5 in FIG. 1.

FIG. 6 is a sectional view on an enlarged scale taken along the line 6—6 in FIG. 3.

FIG. 7 is a fragmentary view taken along the line 7—7 in FIG. 1.

DESCRIPTION

Referring to FIGS. 1-3, the convenience container includes a metallic closure 10 embodying the invention comprises a metallic panel 11 with a central removable portion 12 defined by an endless score line 13, a peripheral fixed portion comprising an integral safety bead 14 overlying the score line 13, and an annular channel portion 15 whereby the closure can be double seamed to the top of a cylindrical container 16 to close the end of the container 16 (FIG. 6). The convenience closure includes a pull-tab 17 extending generally radially and fastened to the removable panel portion by a rivet 18.

The pull-tab 17 includes a nose portion 19 that is movable adjacent the score line 13 when the pull-tab 17 is lifted by hand causing the severing of the panel at the score line 13. Further pulling of the tab 17 completes the severing and removal of the panel. This general construction is disclosed in the aforementioned United States patents which are incorporated herein by reference. Stiffening means in the form of parallel integral beads 20 formed upwardly from the plane of the removable panel are provided and extend generally parallel to the opening direction, that is, parallel to the longitudinal axis of the pull-tab 17 on the removable portion 12 of the panel 11. The construction of the beads is the subject matter of a copending U.S. application Ser. No. 280,577, filed July 6, 1981, having a common assignee with the present invention.

In accordance with the invention, the pull-tab 17 includes a first generally rectangular portion 21 having an opening 22 therein through which the integral rivet portion 18 of the removable panel 12 extends and is thereafter flattened to fasten the pull-tab 17 to the removable portion of the panel. The pull-tab further includes a second portion 23 extending radially outwardly and defining the nose portion 19 which is positioned adjacent the score line 13 for initiating severing. The pull-tab 17 further includes a manually graspable portion 24 in the form of a ring extending rearwardly by connecting arms 25 generally parallel to the first portion 21. Removable panel 12 is formed with an embossed area 26 of panel which is embossed upwardly and includes a straight edge portion 27 completely to the straight end edge 21*a* of portion 21 of the tab 17 to prevent rotation of the tab 17. Portion 27 preferably comprises an inclined or slanted portion formed by embossing and extending upwardly and inwardly away from the periphery of the closure 10.

As a result, registration of the nose 19 with the scoreline 13 is insured. During opening of the convenience closure or during storage, pivoting or rotation of the pull-tab 17 to a position wherein the nose 19 is out of registry with the score line 13 is prevented.

The embossed area 26 preferably extends to the inner periphery of the ring portion 24 of the pull-tab 17. In addition, the second portion 23 manually graspable portion 24 and arms 24 are formed so that they are curled in cross section as shown in FIGS. 4 and 5 stiffen them. In addition, stiffening grooves 28 are provided along arms 25 and extend into portion 23 curving inwardly toward the nose. The pull-tab 17 is preferably made by moving a strip S of metal progressively by stamping.

I claim:

1. A metallic convenience closure for a cylindrical container comprising a central panel, an endless severing line formed in the central panel and defining a central removable portion and a peripheral fixed portion, means forming a part of the fixed portion for attaching a closure to the end of a container to close the end, a manually graspable pull-tab attached to the removable portion of the panel and having a nose portion movable upon lifting of the tab into position adjacent the score line for severing the score line, said tab including a first portion riveted to said removable portion of the panel, a second portion extending radially outwardly toward the score line and terminating in said nose portion, and a manual grasping portion integral with the second portion and extending radially inwardly, said first portion having at least one straight edge, said removable portion of the panel having a portion thereof deformed including a complementary straight edge engaging the straight edge of said first portion of the tab preventing rotation of the tab about the axis of the rivet thereby maintaining registry of the nose portion with the score line during the opening of the convenience closure.

2. The metallic convenience closure set forth in claim 1 wherein said deformed portion of said panel comprises an upwardly embossed area.

3. The metallic convenience closure set forth in claim 2 wherein said first portion of said tab is generally rectangular with straight edges extending along the sides and end thereof, said straight edge of the deformed portion of the panel engaging the straight end edge of the first portion of the tab.

4. The metallic convenience closure set forth in claim 3 wherein the manually graspable portion of the pull-tab is generally circular and having a straight portion and a deformed portion of the panel has a complementary configuration.

5. The metallic convenience closure set forth in claim 1 including said manual grasping portion includes arm portions and strengthening grooves in said arm portions extending into said portion toward said nose portion.

* * * * *